US005495741A

United States Patent [19]

Yamada

[11] Patent Number: 5,495,741

[45] Date of Patent: Mar. 5, 1996

[54] APPARATUS FOR BENDING A BAND-SHAPED WORK

[75] Inventor: Toshio Yamada, Osaka, Japan

[73] Assignee: Santex Co. Ltd., Osaka, Japan

[21] Appl. No.: 247,918

[22] Filed: May 23, 1994

[30] Foreign Application Priority Data

May 24, 1993 [JP] Japan ..... 5-121731

[51] Int. Cl.[6] ..... B21D 7/02

[52] U.S. Cl. ..... 72/387; 72/217; 140/106

[58] Field of Search ..... 72/217, 219, 387, 72/388; 140/105, 106

[56] References Cited

U.S. PATENT DOCUMENTS

| | | | |
|---|---|---|---|
| 3,847,189 | 11/1974 | Guzda | 140/106 |
| 3,991,600 | 11/1976 | Del Fabro | 72/217 |
| 5,203,195 | 4/1993 | Ritter et al. | 72/387 |

FOREIGN PATENT DOCUMENTS

| | | | |
|---|---|---|---|
| 0317206 | 12/1956 | Switzerland | 72/217 |
| 0867464 | 9/1981 | U.S.S.R. | 72/387 |

*Primary Examiner*—David Jones

*Attorney, Agent, or Firm*—Panitch Schwarze Jacobs & Nadel

[57] ABSTRACT

An apparatus for bending a band-shaped work, the apparatus including a stationary cylinder having at least a pair of slits on diametrically opposite sides thereof, the slits providing a passageway in which the work is inserted through the slits, a rotary sleeve accepting the stationary cylinder with a gap interposed therebetween, the rotary sleeve having a first opening and a second opening on diametrically opposite sides thereof, a first driving means for feeding the work passed through the passageway in the stationary cylinder and the first and second openings of the rotary sleeve, and a second driving means for rotating the rotary sleeve by a predetermined amount while the movement of the work is stopped so as to bend the work between the stationary cylinder and the rotary sleeve.

1 Claim, 8 Drawing Sheets

Fig. (C)

APPARATUS FOR BENDING A BAND-SHAPED WORK

FIELD OF THE INVENTION

The present invention relates to an apparatus for bending a band-shaped work such as a blade used for punching thin sheets of paper, cloth, leather, wood, and plastics to a desired shape. In this specification, the band-shaped work will be called "bandwork" for explanation convenience.

BACKGROUND OF THE INVENTION

When a band-shaped blade is used to punch a sheet to a desired shape, it is mounted on a base, and fitted in a groove formed therein to the desired shape. In order to enable the band-shaped blade to fit in the groove, the blade should be previously bent at an obtuse angle, an acute angle or right angle depending upon the shapes of the groove and the radius of curvatures as shown in FIG. 8 where the full line indicates the contour to be punched along and the dotted lines indicate the foldable lines.

There are at least four known methods of bending a bandwork; first, by hand with a special tool; second, by means of three rollers (FIG. 9A); third, by means of a pair of molds each having a required radius of curvature where the work held between the molds is punched under a single blow (FIG. 9B), and fourth, by gradually bending the bandwork while it is fed through a pair of chips inch by inch (FIG. 9C).

The last-mentioned method encounters two difficulties; one is that when a bandwork is bent at one spot at an obtuse angle, it often happens that the subsequent bending is difficult by bringing the already bent portion of the bandwork with the apparatus, and the other is that accumulated dimensional errors eventually fails to achieve the intended accuracy.

SUMMARY OF THE INVENTION

According to the present invention, there is provided an apparatus for bending a work such as a bandwork, the apparatus including a stationary cylinder having at least a pair of slits on diametrically opposite sides thereof, the slits providing a passageway in which the work is inserted through the slits, a rotary sleeve accepting the stationary cylinder with a gap interposed therebetween, the rotary sleeve having a first opening and a second opening on diametrically opposite sides thereof, a first driving means for feeding the work passed through the passageway in the stationary cylinder and the first and second openings of the rotary sleeve, and a second driving means for rotating the rotary sleeve by a predetermined amount while the movement of the work is stopped so as to bend the work between the stationary cylinder and the rotary sleeve.

The gap between the stationary cylinder and the rotary sleeve keeps the work safe from collision with the apparatus, and minimizes a dimensional error possibly occurring at each spot, thereby achieving the dimensional accuracy.

BRIEF DESCRIPTION OF THE DRAWINGS

FIGS. 5(A), 5(B), and 5(C) are diagrammatic views showing the conditions of a bent bandwork in Phases (A) (B) and (C);

DETAILED DESCRIPTION OF THE PREFERRED EMBODIMENT

Figure 2:
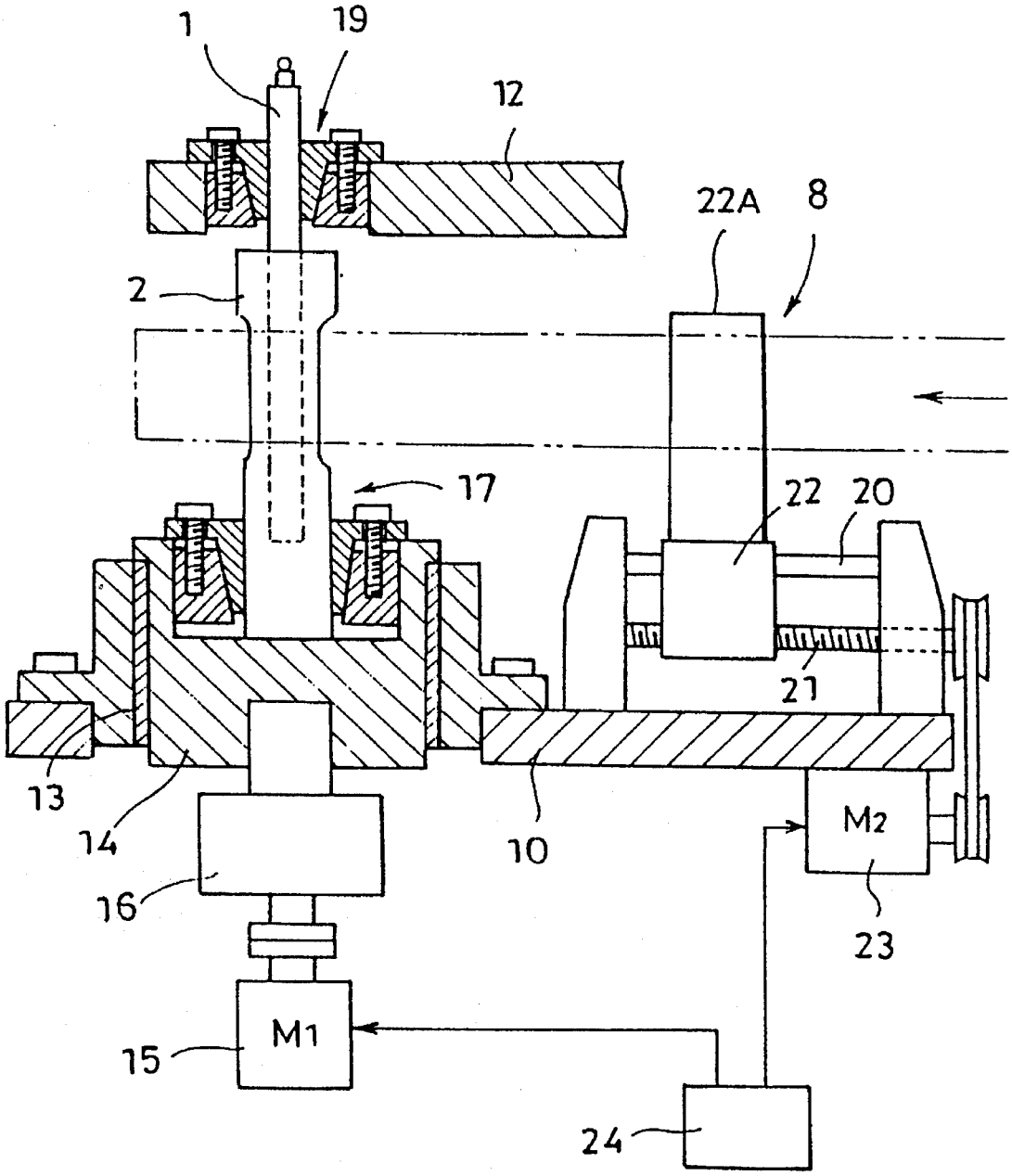
FIG. 2 is a diagrammatic view showing the overall structure of the apparatus embodying the present invention.
Figure 3:
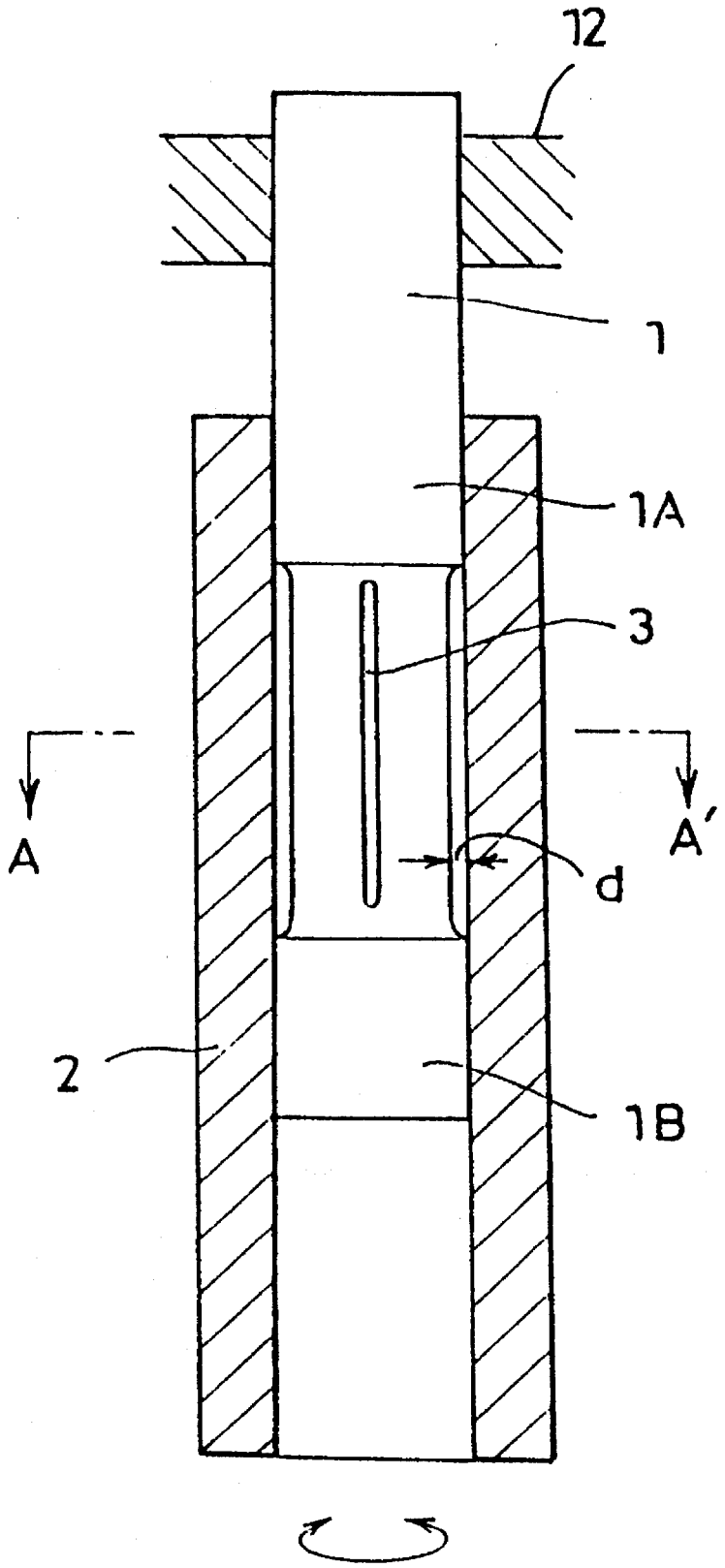
FIG. 3 is a diagrammatic cross-section showing the stationary cylinder and the rotary sleeve shown in FIG. 2.
Figure 4:
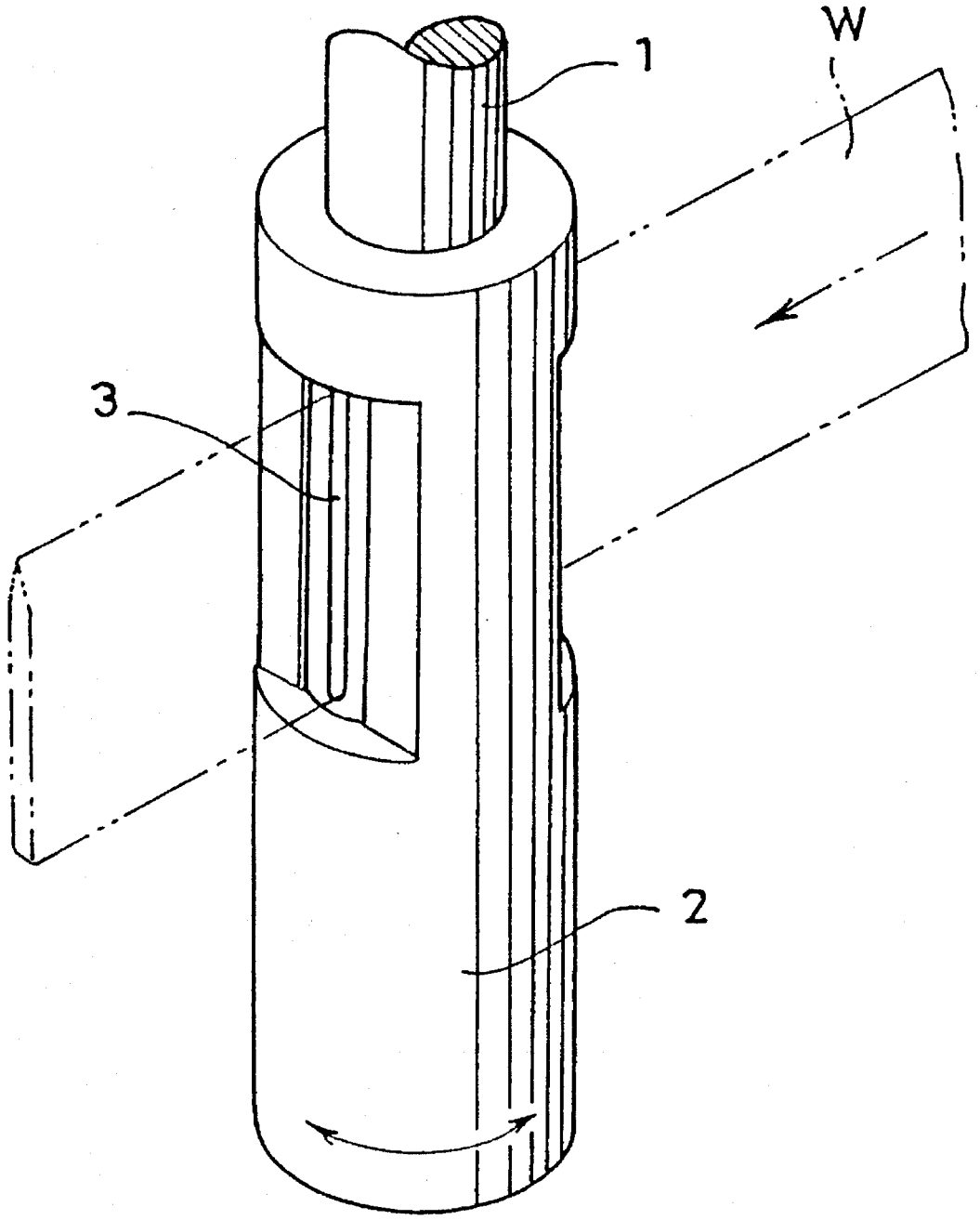
FIG. 4 is a perspective view showing the stationary cylinder and the rotary sleeve in operation.
Figure 5A:
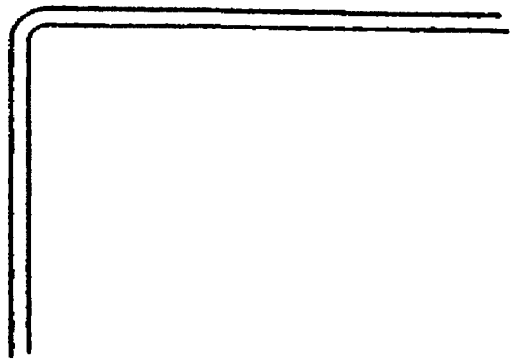
Figure 5B:
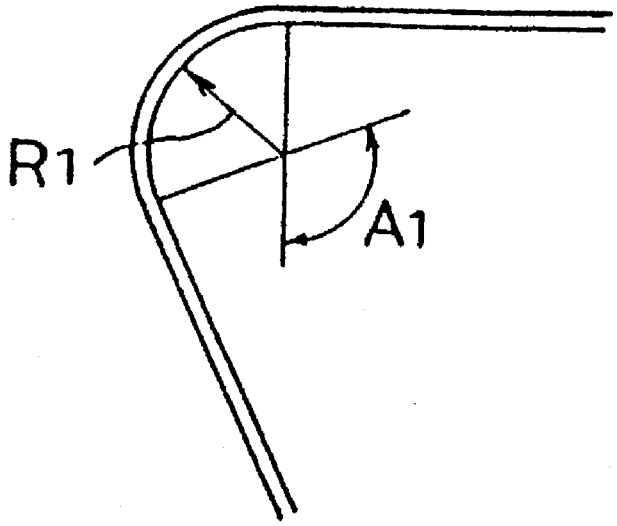
Figure 5B:
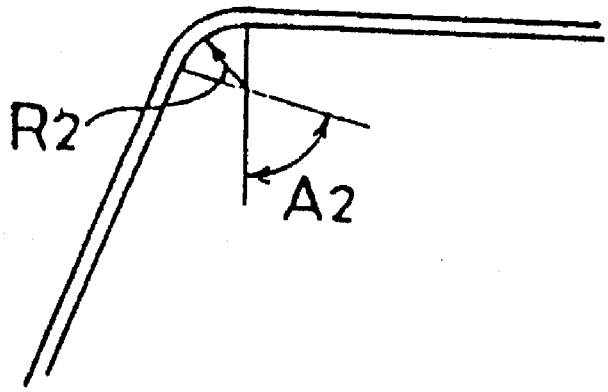

Referring to FIG. 2, the exemplary apparatus includes a bed 10, an upper support 12 detachable fixed to the bed 10 by pillars (not shown), and a rotor 14 rotatably carried on the bed 10 through bearings 13. The rotor 12 is driven by a servomotor 15 through a speed reducer 16. A lower chuck 17 holds a rotary sleeve 2 which is secured to the top surface of the rotor 12, and an upper chuck 19 is held by the upper support 12. The upper chuck 19 holds a stationary cylinder 1 which is inserted in the rotary sleeve 2. The upper chuck 19 and the lower chuck 17 are coaxially aligned, and the stationary cylinder 1 is coaxially accepted in the rotary sleeve 2. The rotary sleeve 2 rotates when the rotor 14 is driven. The chucks 17 and 19 are designed to allow a substitute rotary sleeve and stationary cylinder to be used depending upon the thickness of the work.

Figure 1:
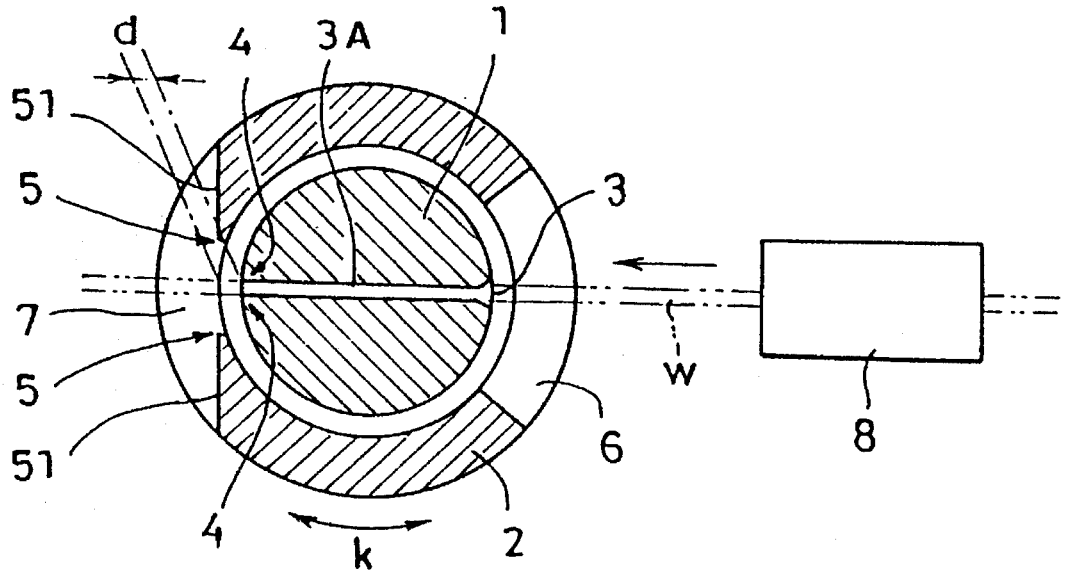
FIG. 1 is a diagrammatic view exemplifying the principle underlying the present invention, particularly showing a main portion of the apparatus.

Referring to FIGS. 1 to 4, the shank of the stationary cylinder 1 is provided with thick portions 1A and 1B and a slim portion interposed between the thick portions 1A and 1B. The slim portion has a pair of slits 3 on diametrically opposite sides thereof so as to provide a passageway 3A for allowing a work W to straightly pass through. Different stationary cylinders have slits having different widths. Depending upon the thickness of the work W, they are selected. The thick portions 1A and 1B are in sliding contact with the inside wall of the rotary sleeve 2. The rotary sleeve 2 is provided with axially lengthwise openings 6 and 7 on diametrically opposite sides thereof. The openings 6 and 7, and the slits 3 may be in alignment in accordance with the rotation of the rotary sleeve 2. The opening 6 is located at the entrance through which the work W is inserted into the rotary sleeve 2 (therefore, the slits 3), and the opening 7 is located at the exit through which the work W exits out of the rotary sleeve as shown in FIG. 1. The rotary sleeve 2 is provided with a relief 51 in the opening 7. Each slit 3 has edges 4 along the terminating corners of the side through which the work W exits, and the rotary sleeve 2 has edges 5 mating with the edges 4 of the slits 3. The edges 5 are movable in accordance with the motion of the rotary sleeve 2 in the directions of K whereas the edges 4 are motionless. The amount of rotation of the rotary sleeve 2 is expressed in angle, and the rotational angle is accurately adjusted by controlling the servomotor 15.

In order to drive a work W inserted into the passageway 3A through the slits 3, there is provided a feeder unit 8 which includes a feed shaft 20 and a lead screw 21 kept in parallel with the feed shaft 20, and a carriage 22 carried on the lead screw 21. The carriage 22 includes a clamp 22A for holding the work W with its blade upward. The lead screw 21 is driven by a second servomotor 23. The first and second servomotors 15 and 23 are controlled by a computer 22 under the program shown in FIG. 6.

Figure 6:
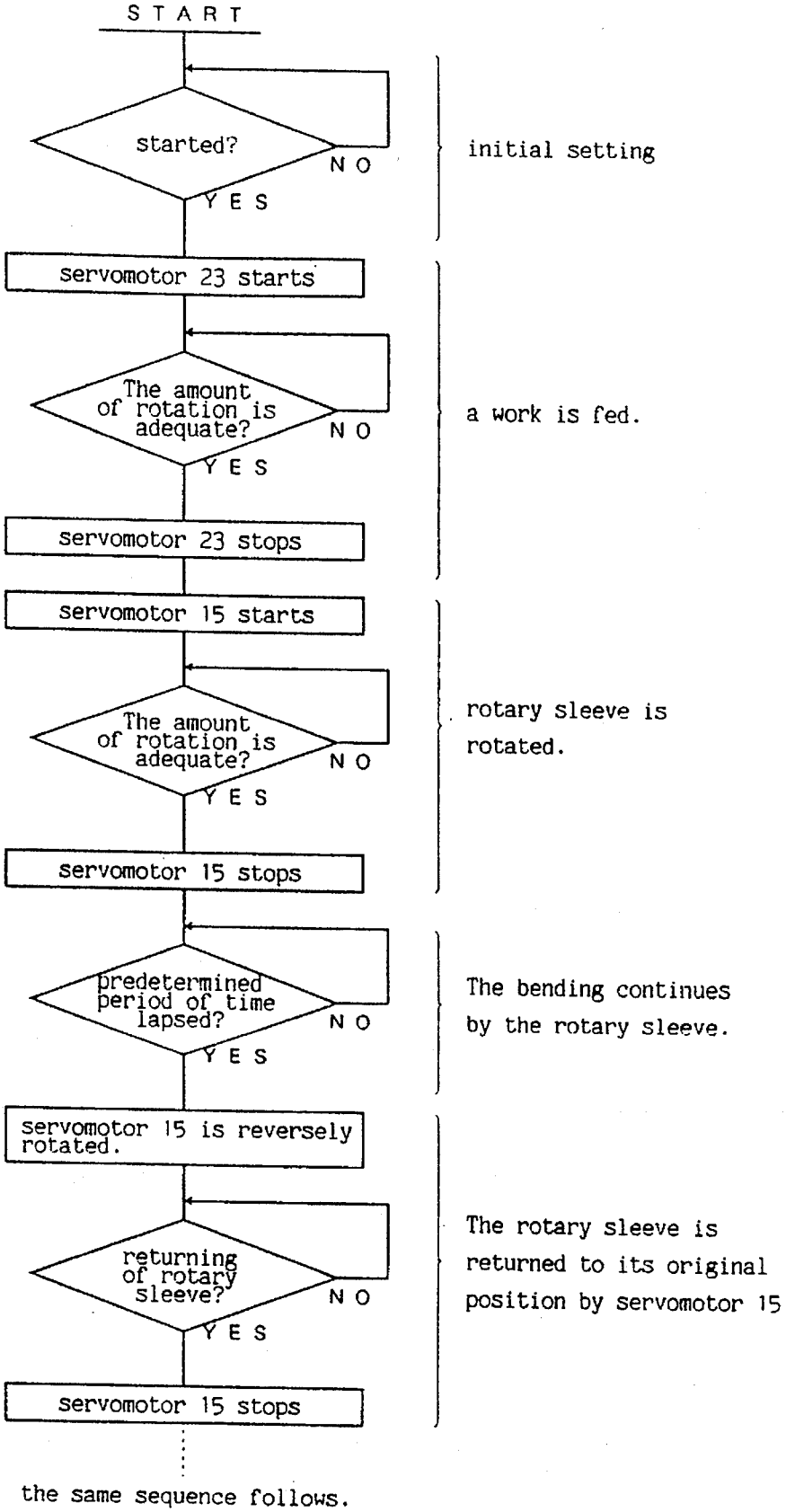
FIG. 6 is a flowchart showing the sequence programmed under the present invention.

The work W is intermittently fed by the feeder unit 8, for example, 1 mm by 1 mm. While the work W is at rest, the rotary sleeve 2 is rotated so as to bend the work W by and between the edges 4 and 5. The amount of rotation of the rotary sleeve 2 depends upon the desired bending angle. The rotary sleeve 2 is returned and waits for the subsequent movement of the work W, and then resumes its rotation. The operation will be described in detail by reference to FIG. 6:

Referring to FIG. 6, the program of the computer 22 is prepared so as to meet the following aspects (A), (B) and (C):

Aspect (A): When the work W is bent at 90° with a small radius of curvature;

Aspect (B): When the work W is bent at acute angle $A_1$ with a radius of curvature $R_1$; and Aspect (C): When the work W is bent at obtuse angle $A_2$ with a radius of curvature $R_2$.

A predetermined length of the work w is fed by the second servomotor 23 (Step 1). The rotary sleeve 2 is rotated by a predetermined amount by means of the first servomotor 15 (Step 2). The first servomotor 15 is reversely rotated (Step 3). The sequence is executed by repeating the three steps. When the carriage 22 reaches at the forward dead point of stroke, the clamps 22A are unfastened, and the carriage 22 is returned straightly to its original position. The feeding of the work W is resumed.

Figure 7:
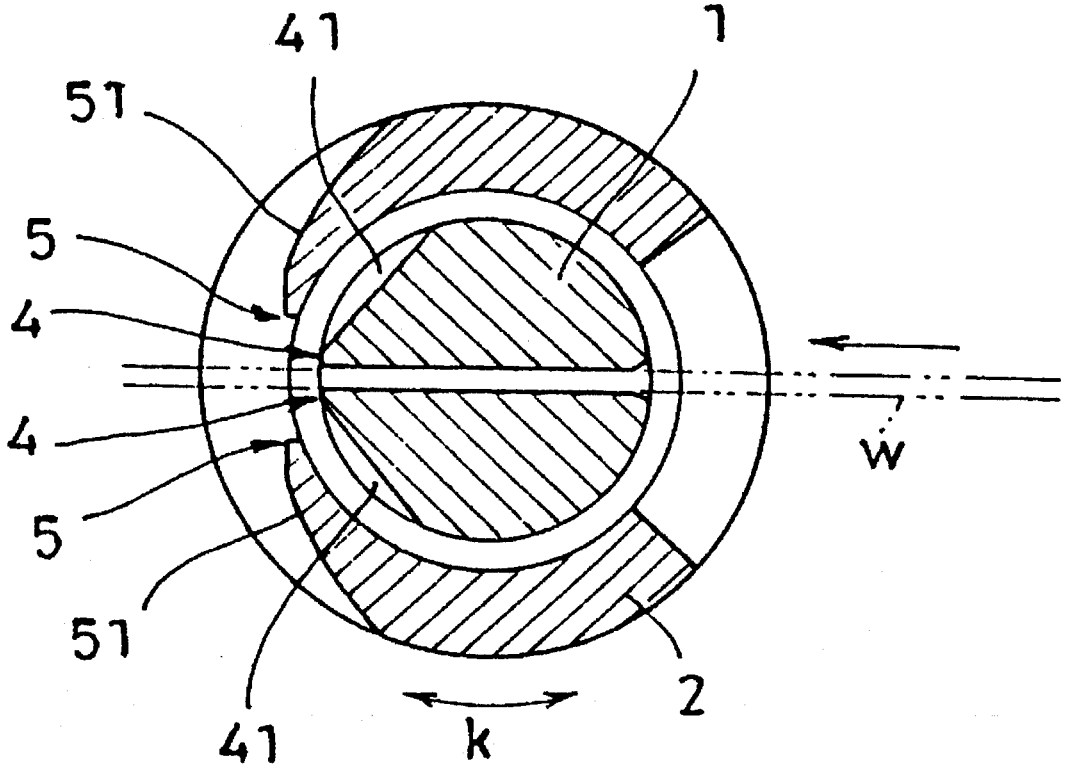
FIG. 7 is a diagrammatic view showing a modification to the embodiment shown in FIG. 1.
Figure 8:
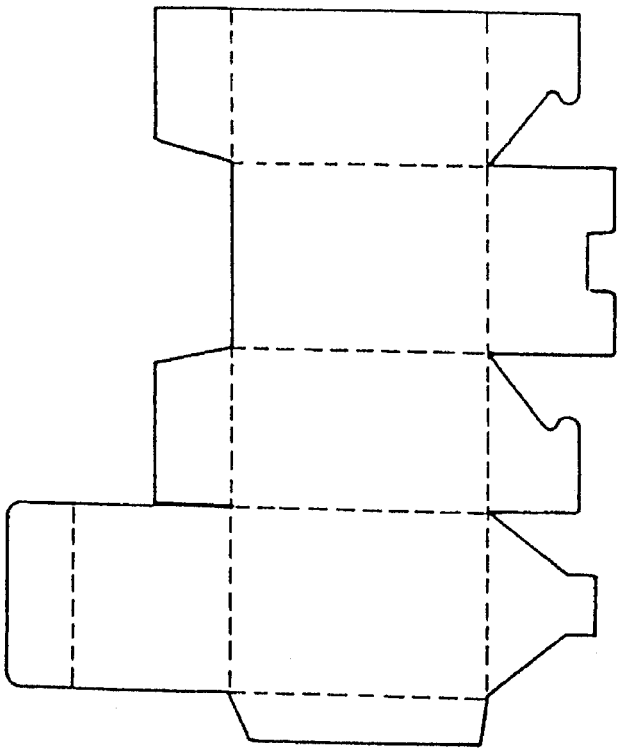
FIG. 8 is a plan view showing a shape to be punched from a sheet.
Figure 9A:
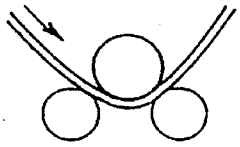
FIGS. 9(A), 9(B), and 9(C) are diagrammatic views showing a known method of bending a bandwork.
Figure 9B:
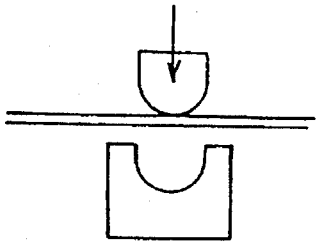
(PRIOR ART) Fig.9(B)
Figure 9C:
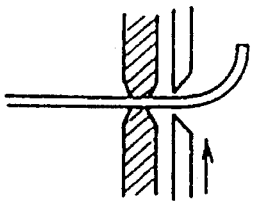

FIG. 7 shows a modified version of the reliefs in the rotary sleeve 2 and the stationary cylinder 1 in which another relief 21 is provided on each side of the stationary cylinder 1, and the reliefs 51 of the rotary sleeve 2 are made larger than those shown in FIG. 1.

What is claimed is:

1. An apparatus for bending a band-shaped work, the apparatus comprising:

a stationary cylinder having at least a pair of slits on diametrically opposite sides thereof, the slits providing a passageway in which the work is inserted through the slits;

a rotary sleeve accepting the stationary cylinder with a gap interposed therebetween, the rotary sleeve having a first opening and a second opening on diametrically opposite sides thereof;

a first driving means for feeding the work passed through the passageway in the stationary cylinder and the first and second openings of the rotary sleeve;

a second driving means for rotating the rotary sleeve by a predetermined amount while the movement of the work is stopped so as to bend the work between the stationary cylinder and the rotary sleeve;

a first adjustable chuck for receiving and supporting rotary sleeves of various sizes, the first adjustable chuck being drivingly coupled to the second driving means and supporting the rotary sleeve; and a second adjustable chuck for receiving and supporting stationary cylinders of various sizes, the second adjustable chuck supporting the stationary cylinder, the first and second chucks being coaxially aligned.

* * * * *

UNITED STATES PATENT AND TRADEMARK OFFICE

CERTIFICATE OF CORRECTION

PATENT NO. : 5,495,741

DATED : March 5, 1996

INVENTOR(S) : Toshio Yamada

It is certified that error appears in the above-identified patent and that said Letters Patent is hereby corrected as shown below:

Title page, item [73] assignee: should read --Suntex Co., Ltd., Osaka, Japan--.

Signed and Sealed this

Eighth Day of October, 1996

*Attest:*

Bruce Lehman

BRUCE LEHMAN

*Attesting Officer*

*Commissioner of Patents and Trademarks*